United States Patent [19]

Wilson

[11] Patent Number: 4,976,125

[45] Date of Patent: Dec. 11, 1990

[54] LEAF SPRING PRODUCTION

[75] Inventor: Alexander I. Wilson, Sheffield, England

[73] Assignee: Ian Wilson Technology Limited, Sheffield, England

[21] Appl. No.: 409,715

[22] Filed: Sep. 20, 1989

[30] Foreign Application Priority Data

Sep. 27, 1988 [GB] United Kingdom ..... 8822608

[51] Int. Cl.[5] ..... B21D 7/02; B21D 53/88

[52] U.S. Cl. ..... 72/21; 72/413

[58] Field of Search ..... 72/413, 323, 21, 35, 72/36, 702, 31; 29/173

[56] References Cited

U.S. PATENT DOCUMENTS

| | | | |
|---|---|---|---|
| 1,105,982 | 8/1914 | Litchfield | 72/413 |
| 1,776,082 | 9/1930 | Peterson | 72/413 |
| 3,426,569 | 2/1969 | Brauer | 72/413 |
| 4,212,188 | 7/1980 | Pinson | 72/413 |
| 4,640,113 | 2/1987 | Dieperink | 72/21 |
| 4,802,357 | 2/1989 | Jones | 72/702 |

FOREIGN PATENT DOCUMENTS

| | | | |
|---|---|---|---|
| 766706 | 9/1980 | U.S.S.R. | 72/413 |

*Primary Examiner*—Daniel C. Crane

*Attorney, Agent, or Firm*—Cushman, Darby & Cushman

[57] ABSTRACT

A leaf spring shaping machine including upper and lower spring forming elements one of which is constituted by a plurality of closely spaced abutment members, and a mechanism for adjusting and constantly monitoring the positions of said abutment members individually in order to adjust and maintain the effective shape of the one spring forming element. The other of the spring forming elements may be constituted by a pair of arms pivotally connected together and extending outwards from a vertically movable seat clamp which together with a fixed block forms a workpiece clamping arrangement.

8 Claims, 2 Drawing Sheets

LEAF SPRING PRODUCTION

FIELD OF THE INVENTION

The invention relates to leaf spring production.

The conventional method of producing leaf springs involves the cutting to length of a section of flat bar, a taper rolling operation to vary the thickness of the bar along its length, and in some cases the appropriate forming of at least one and possibly both of the free ends of the tapered blank, for example the forming of the or each end into a closed loop for the subsequent attachment of a shackle to the finished spring. Subsequent operations during the production of the spring include the heating of the tapered blank in a furnace to a predetermined temperature and its quenching in oil between the dies or jigs of a forming press to bring the tapered blank to a required shape. Final operations in the production of the spring include a tempering operation in another furnace and various finishing operations such as shot peening.

A particular drawback in the production of leaf springs by the method just described is that it is slow and usually labour intensive. Because each tapered blank generally needs to be held between the dies or jigs in the quenching oil for a period of several minutes, the method usually involves the use of a multiplicity of quenching stations, each involving manual loading and unloading of the tapered blanks. A further drawback is that each required spring shape requires a particular pair of jigs or dies with the result that relatively short production runs involve frequent jig changes, this resulting in low plant availability. A large number of pairs of dies or jigs are required and these require a large storage area. If the tapered blank is shaped in a bending jig, the shape of the jig can vary throughout a working day due to temperature variations. The shape of such a jig may sometimes be modified whilst hot to compensate for such variations, but this can then result in the shape being wrong when the jig is cold.

The invention has for its object to at least alleviate the drawbacks referred to.

SUMMARY OF THE INVENTION

According to one aspect of the invention, there is provided a method of producing leaf springs, the method including the steps of placing a pre-formed blank between upper and lower elements of a spring shaping machine, adjusting and constantly monitoring the effective shape of one of said elements and bringing the other of said elements into engagement with the pre-formed blank so that the latter is brought to the shape of said one of said elements. After being brought to the shape of said one of the elements of the spring shaping machine, the pre-formed blank will preferably be deposited in an oil filled bath for quenching.

The method may involve a certain degree of bending of the blank beyond the final shape required, this allowing for the 'spring-back' of the blank which takes place as it is deposited in the oil filled bath. Alternatively, whilst still being held between the upper and lower elements of the machine the pre-formed blank may be lowered into the oil filled bath for quenching, but after an initial quench the blank may be deposited from between the two elements to remain in the oil for a further period and allowing the two elements to resume work on a further blank.

According to another aspect of the invention, there is provided a leaf spring shaping machine including upper and lower spring forming elements one of which is constituted by a plurality of closely spaced abutment members, means for adjusting and constantly monitoring the positions of said abutment members individually in order to adjust and maintain the effective shape of said one spring forming element, and means for bringing the other of said spring forming elements into engagement with a pre-formed blank located between said elements so that said blank is brought to the shape of said one of the elements. The abutment members may be equally distributed on opposite sides of a fixed block forming part of a workpiece clamping arrangement.

Said other of the spring forming elements may be constituted by a pair of arms pivotally connected together and extending outwards from a vertically movable seat clamp which together with the fixed block forms the workpiece clamping arrangement. A centrally located hydraulic ram will preferably be provided for lifting and lowering the seat clamp and the pair of arms bodily so that a central portion of a tapered blank can be clamped between the fixed block and said seat clamp. A pair of hydraulic rams will preferably be pivotally connected to outermost parts of the arms, the arrangement being such that when said centrally located hydraulic ram has been extended to clamp a tapered blank in position, said pair of rams can be extended to displace the oppositely extending tapered lengths of the blank into engagement with the one spring forming element. The pair of hydraulic rams will preferably be trunnion mounted.

Each arm of the other of the spring forming elements will preferably have a roller carried by a bracket some distance from the pivotal connection of the two arms, there being a plurality of adjustable roller units between said pivotal connection and the bracket on each arm. The roller of each adjustable roller unit will preferably be acted on by hydraulic pressure within the unit. Means will preferably be provided to locate the arms against misalignment as the hydraulic rams displace them to act against the oppositely extending lengths of the tapered blank.

The means for adjusting and constantly monitoring the positions of the abutment members will preferably include an adjusting carriage mounted on wheels engaging a track extending along the top of structure from which said abutment members depend, the adjusting carriage carrying a stepper motor unit and means whereby a driving connection can be established between said motor unit and the adjusting screw of any one of the abutment members with which it has been aligned. A rotatable traverse screw will preferably extend across the structure and engage a non-rotatable nut carried by the adjusting carriage, a reversible geared down electric motor unit being drivably connected to the traverse screw to drive the adjusting carriage in either direction according to its direction of rotation, an encoder preferably also being connected to said traverse screw to provide a signal giving the position of the adjusting carriage and enabling the adjusting carriage to be brought into alignment with the adjusting screws of all the abutment members in turn. Devices will preferably be associated with the adjusting screws for indicating the positions of the respective abutment members, whereby, by means of a computer it is possible for the positions of all the abutment members to be re-set in a very short space of time, the adjusting carriage visiting all the adjusting screws in turn and positioning the abutment members by numerical control.

DESCRIPTION OF THE PREFERRED EMBODIMENT

Figure 1:
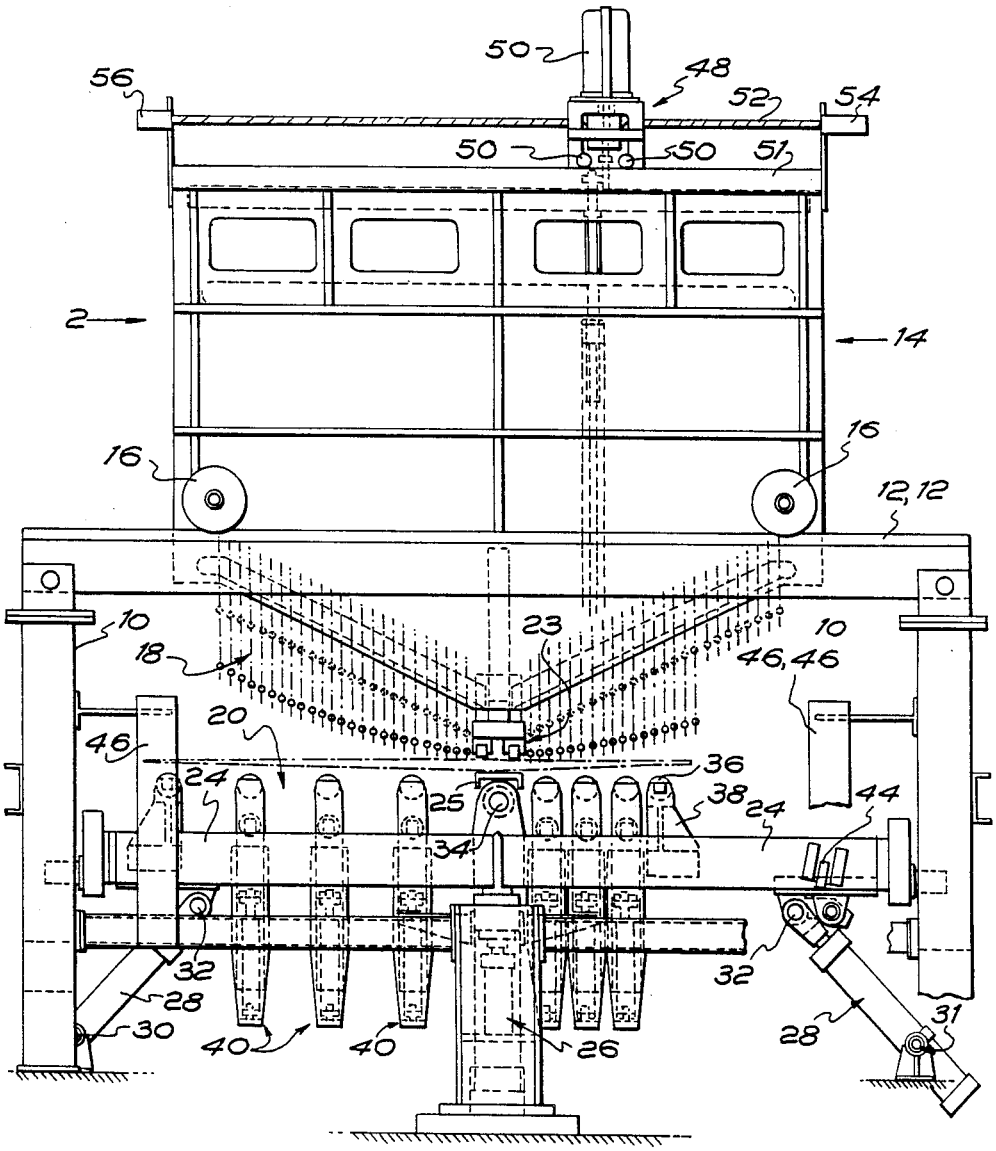
FIG. 1 is a front elevation of a leaf spring shaping machine embodying the invention.
Figure 2:
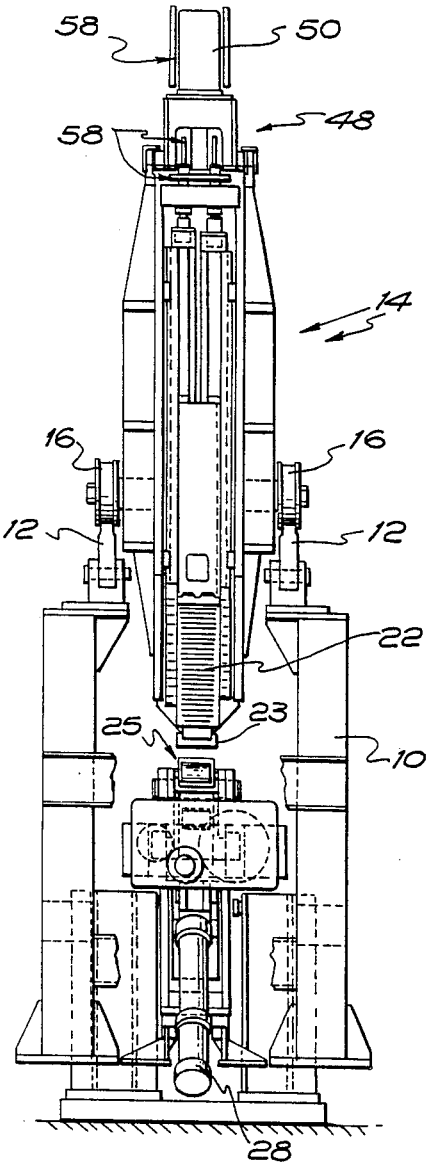
FIG. 2 is a partly broken away view in the direction of arrow 2 in FIG. 1.

Referring now to the drawings, the leaf spring shaping machine there illustrated includes upstanding frame members 10 at its opposite ends. A pair of rails 12 extend between the upper ends of the frame members, said rails serving to support structure, generally indicated 14, which is provided with pairs of flanged wheels 16 engaging said rails. Means (not shown) are provided for clamping said structure in an adjusted position on said pair of rails.

The machine also includes upper and lower spring forming elements generally indicated 18 and 20 respectively. The spring forming element 18 is constituted by a plurality of closely spaced abutment members 22 depending from the structure 14, the abutment members being equally distributed on opposite sides of a fixed block 23 forming part of a workpiece clamping arrangement. Means which will presently be described are provided for adjusting and constantly monitoring the positions of said abutment members in order to adjust and maintain the effective shape of the spring forming element 18.

The spring forming element 20 is constituted by a pair of arms 24,24 which extend outwards from a vertically movable seat clamp 25 which together with the fixed block 23 forms the workpiece clamping arrangement. A hydraulic ram 26 is provided for lifting and lowering the seat clamp 25 and the pair of arms 24,24 bodily so that a central portion of a tapered blank can be clamped between the fixed block 23 and said seat clamp. A pair of hydraulic rams 28,28 trunnion mounted at 30,30 are pivotally connected at 32,32 to outermost parts of the arms 24,24, the arrangement being such that when the hydraulic ram 26 has been extended to clamp a tapered blank in position, as shown in chain-dotted lines in FIG. 1, the pair of hydraulic rams 28,28 can be extended to cause the arms 24,24 to displace the oppositely extending tapered lengths of the blank upwardly into engagement with the upper spring forming element.

As shown, the innermost ends of the arms 24,24 are pivotally connected together immediately beneath the seat clamp 25 about the axis of a pivot pin 34. Some distance away from said pivot pin, along each arm there is a roller 36 freely rotatable in a bracket 38 fixed to the arm. Intermediate the pivot pin and the roller 36, each arm carries three adjustable roller units generally indicated 40, the roller 42 of each adjustable roller unit being acted on by a hydraulic pressure within the unit tending to force the respective roller outwards to a position in line with the roller 36 as indicated in chain-dotted lines in FIG. 1. Rollers 44 on opposite sides of each arm near their outer ends are arranged to bear against pairs of flat plates 46,46 which are carried by the upstanding frame members 10. The arms are thereby located against misalignment as the hydraulic rams 28,28 displace them upwards to act against the oppositely extending lengths of a tapered blank.

The means previously referred to for adjusting and constantly monitoring the positions of the abutment members 22 depending from the structure 14 include an adjusting carriage, generally indicated 48, which is mounted on pairs of wheels 50,50 engaging a track 51 extending along the top of the structure 14. The adjusting carriage carries a geared down electric motor unit 50 and means (not shown) whereby a driving connection can be established between said motor unit and the adjusting screws of any one of the abutment members with which it has been aligned. A rotatable traverse screw 52 extends across the top of the structure 14 and engages a non-rotatable nut (not shown) carried by the adjusting carriage. A reversible geared down electric motor unit 54 is drivably connected to the traverse screw and can drive the adjusting carriage in either direction according to its direction of rotation. An encoder 56 which is also connected to the traverse screw provides a signal giving the position of the adjusting carriage. The adjusting carriage can therefore be brought into alignment with the adjusting screws of all the abutment members 22 in turn. Devices 58 associated with the upper ends of the adjusting screws are provided for indicating the positions of the respective abutment members. Consequently, by means of a computer (not shown) it is possible for the positions of all the abutment members to be re-set in a very small space of time, the adjusting carriage visiting all the adjusting screws in turn and positioning the abutment members by numerical control. It will thus be understood that a rapid change can be made from one particular leaf spring shape to another and that for this reason plant availability is high. It also becomes much more economical to produce relatively short numbers of leaf springs in a production run. Because pairs of differently shaped dies do not need to be stored, the previously required large storage area is no longer required.

Means (not shown) are associated with the shaping machine just described for depositing the shaped blank into a bath of oil for quenching. The depositing of the shaped blank into the quenching bath instead of a controlled lowering of the blank into the bath overcomes the fire hazard which exists in performing the latter process; if the lowering of the blank into the bath is too slow or is interrupted in any way there is the danger that the hot blank may ignite the oil.

Various modifications may be made. For example, it would be possible for the shaping machine just described to form part of a leaf spring production process involving the quenching in oil of the pre-formed blank whilst still held between the upper and lower elements of the machine. Consequently, instead of being rigidly mounted on a foundation, as indicated in the drawings, the machine would be mounted on vertically movable structure so that the leaf spring blank, when clamped between the upper and lower elements of the machine, could be lowered into a bath of oil for quenching.

It will also be understood that it is not essential for the abutment members of the one spring forming element to be adjustable by means of a single adjusting carriage; for example the provision of two such adjusting carriages could halve the time required to re-set the effective shape of the spring forming element for a different production run. Indeed, it would be possible to provide each abutment member with its own individual adjustment mechanism and in this case the laterally movable adjusting carriage would not be required. Alternatively, or in addition to this, the machine may be provided with spare support structure 14 which can be adjusted whilst the machine is in operation. Being mounted on flanged wheels 16 engaging the pair of rails 12 and extensions of said rails alongside the machine it will then be a simple matter to move aside the support structure previously in use and to replace it by the already adjusted spare support structure.

What I claim and desire to secure by Letters Patent is:

1. A leaf spring shaping machine, comprising;

upper and lower spring forming elements one of which is constituted by a plurality of closely spaced abutment members;

means for adjusting and constantly monitoring the positions of said abutment members individually in order to adjust and maintain the effective shape of said one spring forming element;

means for bringing the other of said spring forming elements into engagement with a pre-formed blank located between said elements so that said blank is brought to the shape of said one of the elements;

means for clamping a workpiece comprising a fixed block centrally located with respect to said abutment members and a vertically movable seat clamp;

said other spring forming element comprising a pair of arms pivotally connected to, and extending outwards from, said movable seat clamp;

a central hydraulic ram connected to said seat clamp so as to be able to lift and lower said seat clamp so that a central portion of said blank can be clamped between said fixed block and said seat clamp;

a pair of outer hydraulic rams each pivotally connected to an outermost portion of said arms so as to allow said arms to move, placing oppositely extended tapered lengths of a blank into engagement with said one spring forming element when said central hydraulic ram has been extended to clamp a tapered blank in said means for clamping.

2. A leaf spring shaping machine according to claim 1, in which each arm of the other of the spring forming elements has a roller carried by a bracket some distance from the pivotal connection of the two arms, there being a plurality of adjustable roller units between said pivotal connection and the bracket on each arm, the roller of each adjustable roller unit being acted on by hydraulic pressure within the unit.

3. A leaf spring shaping machine as described in claim 1, in which means are provided to locate the arms against misalignment as they are displaced to act against the oppositely extending of the tapered blank.

4. A leaf spring shaping machine as described in claim 2 in which means are provided to locate the arms against misalignment as they are displaced to act against the oppositely extending of the tapered blank.

5. A leaf spring shaping machine according to claim 1, in which the means for adjusting and constantly monitoring the positions of the abutment members include an adjusting carriage mounted on wheels engaging a track extending along the top of a structure from which said abutment members depend, the adjusting carriage carrying a stepper motor unit and means whereby a driving connection can be established between said motor unit and the adjusting screw of any one of the abutment members with which it has been aligned.

6. A leaf spring shaping machine according to claim 1, in which the means for adjusting and constantly monitoring the positions of the abutment members include an adjusting carriage mounted on wheels engaging a track extending along the top of structure from which said abutment members depend, the adjusting carriage carrying a stepper motor unit and means whereby a driving connection can be established between said motor unit and the adjusting screw of any one of the abutment members with which it has been aligned, a rotatable traverse screw extends across the structure and engages a non-rotatable nut carried by the adjusting carriage, a reversible geared down electric motor unit being drivably connected to the traverse screw to drive the adjusting carriage in either direction according to its direction of rotation.

7. A leaf spring shaping machine according to claim 6, in which an encoder is connected to the traverse screw to provide a signal giving the position of the adjusting carriage and enabling the adjusting carriage to be brought into alignment with the adjusting screws of all the abutment members in turn.

8. A leaf spring shaping machine according to claim 6, in which an encoder is connected to the traverse screw to provide a signal giving the position of the adjusting carriage and enabling the adjusting carriage to be brought into alignment with the adjusting screws of all the abutment members in turn, and devices are associated with the adjusting screws for indicating the positions of the respective abutment members, whereby, means for re-setting the positions of all the abutment members in a very short space of time, the adjusting carriage engaging with all the adjusting screws in turn and positioning the abutment members by numerical control.

* * * * *